US006649081B1

(12) United States Patent
Johnson et al.

(10) Patent No.: US 6,649,081 B1
(45) Date of Patent: Nov. 18, 2003

(54) AQUEOUS LIQUID DEOXIDIZING COMPOSITION AND PROCESS FOR ALUMINUM, WITH LOW FOAMING TENDENCY

(75) Inventors: Philip M. Johnson, Southfield, MI (US); Lawrence R. Carlson, Waterford, MI (US); Donna A. Garrigues, Orion Towship, MI (US)

(73) Assignee: Henkel Corporation, Gulph Mills, PA (US)

( * ) Notice: Subject to any disclaimer, the term of this patent is extended or adjusted under 35 U.S.C. 154(b) by 359 days.

(21) Appl. No.: 09/275,386

(22) Filed: Mar. 24, 1999

Related U.S. Application Data

(60) Provisional application No. 60/079,163, filed on Mar. 24, 1998.

(51) Int. Cl.[7] ..... C09K 13/00

(52) U.S. Cl. ..... 252/79.1; 252/79.2; 252/79.3; 252/79.4

(58) Field of Search ..... 252/79.1, 79.2, 252/79.3, 79.4; 134/1.3; 438/745, 754

(56) References Cited

U.S. PATENT DOCUMENTS

| | | | | | |
|---|---|---|---|---|---|
| 4,370,256 | A | | 1/1983 | Oakes | 252/391 |
| 4,915,781 | A | * | 4/1990 | Bohnen et al. | 252/79.2 |
| 4,917,758 | A | * | 4/1990 | Ishizuka et al. | 252/79.2 |
| 5,052,421 | A | * | 10/1991 | McMillen | 134/2 |
| 5,364,603 | A | | 11/1994 | Christian et al. | 423/104 |
| 5,376,387 | A | | 12/1994 | Monticello | 424/616 |
| 5,637,252 | A | * | 6/1997 | Johnson et al. | 252/79.3 |
| 5,741,432 | A | * | 4/1998 | Wong | 216/108 |

FOREIGN PATENT DOCUMENTS

| | | |
|---|---|---|
| DE | 1621619 | 4/1971 |
| DE | 2555809 | 6/1976 |
| DE | 3212410 | 10/1982 |
| JP | 59232601 | 12/1985 |
| WO | WO 9308317 | 4/1993 |

OTHER PUBLICATIONS

Technical Process Bulletin No. 1291, Rev. May 19, 1992—Henkel Surface Technologies.

Technical Process Bulletin No. 1705, Rev. Apr. 4, 1996—Henkel Surface Technologies.

* cited by examiner

*Primary Examiner*—Benjamin L. Utech
*Assistant Examiner*—Binh X. Tran
(74) *Attorney, Agent, or Firm*—Stephen D. Harper; Mary K. Cameron; Daniel S. Ortiz

(57) ABSTRACT

A deoxidizing liquid composition for aluminum contains in addition to water: fluoroborate anions, preferably from added fluoroboric acid; an acid, preferably nitric acid, that is a substantially stronger acid than either fluoroboric acid or boric acid; an additional oxidizing agent, preferably hydrogen peroxide; and an organic azole compound. Preferably the composition also contains propylene glycol, which is a stabilizer for hydrogen peroxide and also improves deoxidizing results.

2 Claims, No Drawings

AQUEOUS LIQUID DEOXIDIZING COMPOSITION AND PROCESS FOR ALUMINUM, WITH LOW FOAMING TENDENCY

CROSS-REFERENCE TO RELATED APPLICATIONS

Priority is claimed under 35 U.S.C. § 119(e) from Application Serial No. 60/079,163 filed Mar. 24, 1998.

STATEMENT REGARDING FEDERALLY SPONSORED RESEARCH OR DEVELOPMENT

Not applicable.

BACKGROUND OF THE INVENTION

This invention relates to inhibitors, compositions, and processes for deoxidizing and cleaning surfaces of aluminum and its alloys that contain at least 55% by weight of aluminum (all such alloys being hereinafter to be understood as encompassed within the scope of the term "aluminum" unless the context requires otherwise), while minimizing the etching of titanium. "Deoxidizing" is to be understood herein as the removal from the surface of metals of oxide films and other adherent inorganic materials that would reduce adhesion to subsequently applied protective coatings such as conversion coatings and/or paints and the like, and "cleaning" means removal of all other foreign materials, especially organic soils and poorly adherent inorganic substances such as metal dust and the like, that would reduce adhesion to such subsequently applied protective coatings.

With most deoxidizing agents, especially acidic aqueous liquid compositions with substantial hexavalent chromium and/or free fluoride ion contents, such compositions being probably the most effective chemical classes of cleaners and deoxidizers for aluminum now known, there is a perceptible but controlled etching or dissolution of the aluminum, from its surface inward, while the deoxidizing agent is in contact with it. In the aerospace industry in particular, such deoxidizing is considered a necessity for achieving adequate corrosion resistance for many uses of aluminum. The aluminum parts being deoxidized are often sup ported by racks or other structures of titanium during the deoxidizing process, and etching of these titanium structures during the deoxidizing of aluminum is very disadvantageous, as it decreases the lifetime of the titanium structures and would necessitate frequent replacement of these expensive items.

Hexavalent chromium-containing deoxidizing liquid compositions for the types of aluminum alloys most commonly used in aerospace have low etch rates for titanium. However, the pollution problems associated with hexavalent chromium have motivated efforts to eliminate or reduce its use as much as possible. Most previously developed chromium-free deoxidizers for aluminum, however, have had unsatisfactorily high etch rates on titanium and/or have required an additional process step compared with conventional deoxidizing of aluminum with the use of hexavalent chromium containing deoxidizing liquid compositions, thereby making them unacceptable to most commercial users.

U.S. Pat. No. 5,637,252 of Jun. 10, 1997 to Johnson et al. teaches chromium-free deoxidizing compositions that have acceptably low etch rates for titanium. However, in commercial practice these compositions have sometimes been found objectionable because of one or more of: foaming when used; poorer salt spray test results on the aluminum substrates deoxidized with them, either immediately or after subsequent conventional corrosion resistant surface treatments; and imperfect wetting, as indicated by the presence of "water breaks", i.e., areas of thicknesses of a coating of water that are visibly different from one point to another on the surfaces of the deoxidized aluminum after using these new deoxidizing compositions.

Accordingly, a major object of the invention is to provide compositions and processes for deoxidizing and cleaning aluminum surfaces that also achieve at least one of the following: consistently low corrosion of the aluminum surfaces deoxidized; absence of foaming during use to an extent sufficient to cause operating difficulties; and uniform wetting by water of the deoxidized surface. Another alternative or concurrent object is to reduce pollution potential from aluminum deoxidizing compositions that contain chromium, ferricyanide, or other polluting constituents. Other alternative or concurrent general and/or detailed objects will be apparent from the description below.

Except in the claims and the operating examples, or where otherwise expressly indicated, all numerical quantities in this description indicating amounts of material or conditions of reaction and/or use are to be understood as modified by the word "about" in describing the broadest scope of the invention. Practice within the numerical limits stated is generally preferred, however. Also, throughout the description, unless expressly stated to the contrary: percent, "parts of", and ratio values are by weight or mass; the term "polymer" includes "oligomer", "copolymer", "terpolymer" and the like; the description of a group or class of materials as suitable or preferred for a given purpose in connection with the invention implies that mixtures of any two or more of the members of the group or class are equally suitable or preferred; description of constituents in chemical terms refers to the constituents at the time of addition to any combination specified in the description or of generation in situ within the composition by chemical reaction(s) noted in the specification between one or more newly added constituents and one or more constituents already present in the composition when the other constituents are added, and does not preclude unspecified chemical interactions among the constituents of a mixture once mixed; specification of constituents in ionic form additionally implies the presence of sufficient counterions to produce electrical neutrality for the composition as a whole and for any substance added to the composition; any counterions thus implicitly specified preferably are selected from among other constituents explicitly specified in ionic form, to the extent possible; otherwise such counterions may be freely selected, except for avoiding counterions that act adversely to an object of the invention; the word "mole" means "gram mole", and the word itself and all of its grammatical variations may be used for any chemical species defined by all of the types and numbers of atoms present in it, irrespective of whether the species is ionic, neutral, unstable, hypothetical, or in fact a stable neutral substance with well defined molecules; the terms "solution", "soluble", "homogeneous", and the like are to be understood as including not only true equilibrium solutions or homogeneity but also dispersions that show no visually detectable tendency toward phase separation over a period of observation of at least 100, or preferably at least 1000, hours during which the material is mechanically undisturbed and the temperature of the material is maintained within the range of 18–25° C.; and the first definition of an acronym or other abbreviation applies to all subsequent uses of the same acronym or other abbreviation.

BRIEF SUMMARY OF THE INVENTION

It has been found that a combination of fluoroboric acid, a stronger acid, an oxidizing agent, and at least one azole inhibitor, provides a fully acceptable rate and quality of deoxidizing aluminum and achieves at least one other object of this invention as noted above.

BRIEF DESCRIPTION OF THE SEVERAL VIEWS OF THE DRAWING

Not applicable.

DETAILED DESCRIPTION OF THE INVENTION

One embodiment of the invention is an aqueous liquid composition that is suitable as a deoxidizer for aluminum surfaces and that comprises, preferably consists essentially of, or more preferably consists of, water and:

(A) a component of dissolved acid with a larger ionization constant in water than that of either fluoroboric acid or boric acid;

(B) a component of dissolved fluoroborate anions;

(C) a component of dissolved oxidizing agent that is not part of either of components (A) or (B) as recited next above; and (D) a component of dissolved organic molecules that contain a five-membered ring structure, said ring structure including at least one nitrogen atom, said dissolved organic molecules not being part of any of components (A)–(C) as recited next above; and, optionally, one or more of the following components:

(E) a component of stabilizing agent for the oxidizing agent recited in part (C), the stabilizing agent itself not being part of any of components (A)–(D) as recited next above;

(F) a component of surfactant that is not part of any of components (A)–(E) as recited next above;

(G) a component of dissolved aluminum cations; and (H) a component of supplemental corrosion inhibitor that is not part of any of components (A)–(G) as recited next above.

Various other embodiments of the invention include: (i) a first concentrate that comprises, preferably consists essentially of, or more preferably consists of components (A) and (B) and, optionally, any one or more of components (D)–(H) as recited next above; (ii) a second concentrate that comprises, preferably consists essentially of, or more preferably consists of components (C) and, optionally, any one or more of components (E)–(H) as recited next above; (iii) processes for cleaning and/or deoxidizing aluminum surfaces by contact between the aluminum surfaces and a working composition containing at least components (A)–(D) as recited next above, and (iv) extended processes including additional steps that are conventional per se, such as rinsing, conversion coating, painting, or the like. Articles of manufacture including surfaces treated according to a process of the invention and products made by mixing the ingredients of a composition according to the invention are also within the scope of the invention.

For a variety of reasons, normally always including at least avoidance of the cost of an unnecessary ingredient, it is preferred that compositions according to the invention as defined above should be substantially free from many ingredients used in compositions for similar purposes in the prior art. Specifically, it is increasingly preferred in the order given, independently for each preferably minimized component listed below, that these compositions, when directly contacted with metal in a process according to this invention, contain no more than 1.0, 0.35, 0.10, 0.08, 0.04, 0.02, 0.01, 0.001, or 0.0002% of each of the following constituents: hexavalent chromium; ferric cations; ferricyanide; silica; silicates; thiourea; pyrazole compounds; sugars; gluconic acid and its salts; glycerine; α-glucoheptanoic acid and its salts; myoinositol phosphate esters and salts thereof; polyoxyethylene blocks, or more preferably either polyoxyethylene or polyoxypropylene (jointly denoted hereinafter as "polyoxyalkylene") blocks, that include more than, with increasing preference in the order given, 22, 20, 18, 16, 14, 12, 10, 8, 5, 4, 3, or 2 consecutively joined oxyalkylene moieties.

Furthermore, in a process according to the invention that includes other steps than a cleaning and/or deoxidizing treatment with a composition as described above, when avoidance of environmental pollution is an important consideration, it is preferred that none of these other steps include contacting the surfaces with any composition that contains more than, with increasing preference in the order given, 1.0, 0.35, 0.10, 0.08, 0.04, 0.02, 0.01, 0.003, 0.001, or 0.0002% of hexavalent chromium. On the other hand, the cleaning and/or deoxidizing process taught herein can be advantageously used prior to chromate conversion coating or anodizing in a chromate containing—or, of course, a non chromate containing-solution—where one of these types of treatment is needed.

Strong acid component (A) is preferably supplied by nitric acid. Other strong and preferably inexpensive mineral or organic acids such as sulfuric, phosphoric, trichloroacetic, and oxalic acids can also be used. Acids that yield simple halide ions upon ionization in aqueous solution are generally less preferred, because of the danger of pitting corrosion attack on the aluminum being deoxidized. In a working composition according to the invention when component (A) is derived from nitric acid, the concentration of nitric acid preferably is at least, with increasing preference in the order given, 5, 10, 15, 20, 25, 30, 35, 40, 44, 46, 48, or 50 grams of pure $HNO_3$ per liter of total composition (a concentration unit that may be used hereinafter for any dissolved material as well as for $HNO_3$ and is usually abbreviated as "g/l") and independently preferably is, primarily for economy, not more than, with increasing preference in the order given, 200, 150, 100, 90, 80, 75, 70, 65, 60, 58, 56, 54, or 52 g/l. If another acid than nitric is used, either alone or in a mixture, the preferred concentrations of component (A) in a working composition according to the invention are those that will result in the same pH values, in the complete working composition, as result from using the preferred amounts of nitric acid as specified above.

Component (B), primarily for economy, is preferably derived from fluoroboric acid, although salts of this acid can also be used. The stoichiometric equivalent as $BF_4^-$ anions of all sources of component (A) in a working composition according to the invention-preferably is at least, with increasing preference in the order given, 0.2, 0.4, 0.6, 0.80, 0.90, 1.00, 1.10, 1.20, 1.30, 1.40, 1.44, 1.48, 1.52, 1.55, 1.57, or 1.59 g/l and independently preferably is, primarily for economy, not more than, with increasing preference in the order given, 20, 15, 10, 9.0, 8.0, 7.0, 6.0, 5.5, 5.0, 4.5, 4.0, 3.5, 3.0, 2.5, 2.0, 1.67, 1.64, 1.62, or 1.60 g/l. Independently of the actual concentrations, the ratio of the concentration of the stoichiometric equivalent as $BF_4^-$ anions of all sources of component (B) to the concentration of component (A) when component (A) is nitric acid and the concentrations of components (A) and (B) are both measured in g/l preferably is at least, with increasing preference in the order given, 0.005:1.0, 0.010:1.0, 0.015:1.0, 0.020:1.0, 0.023:1.0, 0.025:1.0, 0.027:1.0, 0.029:1.0, or 0.031:1.0 and independently preferably is not more than, with increasing preference in the order given, 0.20:1.0, 0.15:1.0, 0.10:1.0, 0.080:1.0, 0.065:1.0, 0.055:1.0, 0.050:1.0, 0.045:1.0, 0.040:1.0, 0.036:1.0, 0.034:1.0, or 0.032:1.0. If another acid or a mixture of acids is used for component (A), these ratios should be adjusted to provide the same pH in working compositions as do the above noted preferred ratios for component (A) when it is derived entirely from nitric acid.

Component (C) most preferably consists of hydrogen peroxide, although other peroxides and non-peroxide oxidizing agents can also be used. When only hydrogen peroxide is used for component (C), the concentration of it in a working composition according to the invention preferably is at least, with increasing preference in the order given, 3, 7, 11, 15, 19, 23, 25, 27, 29, 30.0, or 31.0 g/l and independently preferably is, primarily for economy, not more than, with increasing preference in the order given, 190, 140, 110, 90, 80, 70, 60, 50, 45, 40, 39, 37, 35, 34.0, 33.0, or 32.0 g/l. Independently of the actual concentrations, the ratio of the concentration of component (C) when it is constituted of hydrogen peroxide to the concentration of the stoichiometric equivalent as $BF_4^-$ of all sources of component (B), both concentrations being measured in g/l, preferably is at least, with increasing preference in the order given, 2.0:1.00, 4.0:1.00, 6.0:1.00, 8.0:1.00, 10.0:1.00, 12.0:1.00, 13.0:1.00, 13.8:1.00, 14.0:1.00, 14.6:1.00, 15.4:1.00, 16.0:1.00, 16.5:1.00, 17.0:1.00, 17.5:1.00, 18.0:1.00, 18.5:1.00, 19.0:1.00, or 19.5:1.00 and independently preferably is not more than, with increasing preference in the order given, 100:1.00, 80:1.00, 60:1.00, 50:1.00, 40:1.00, 35.0:1.00, 30.0:1.00, 28.0:1.00, 26.0:1.00, 24.0:1.00, 22.0:1.00, 21.5:1.00, 21.0:1.00, 20.5:1.00, or 20.0:1.00; and independently of other preferences and of the actual concentrations, the ratio of the concentration of component (C) when it is constituted of hydrogen peroxide to the concentration of component (A) when component (A) is nitric acid, both concentrations being measured in g/l, preferably is at least, with increasing preference in the order given, 0.10:1.00, 0.20:1.00, 0.30:1.00, 0.40:1.00, 0.50:1.00, 0.54:1.00, 0.57:1.00, 0.580:1.00, or 0.600:1.00 and independently preferably is not more than, with increasing preference in the order given, 4.0:1.00, 3.0:1.00, 2.0:1.00, 1.5:1.00, 1.3:1.00, 1.10:1.00, 1.00:1.00, 0.90:1.00, 0.85:1.00, 0.80:1.00, 0.75:1.00, 0.70:1.00, 0.67:1.00, 0.64:1.00, or 0.62:1.0. If another oxidizing agent or a mixture of oxidizing agents is used instead of only hydrogen peroxide for component (C), these concentrations and ratios should be adjusted so as to provide the same oxidizing power in the compositions as if they were made with the preferred amounts of hydrogen peroxide recited above; the oxidizing power of the composition may be measured for this purpose by the potential of a platinum electrode immersed in the composition, compared to some standard reference electrode maintained in electrical contact with the composition via a salt bridge, flowing junction, semipermeable membrane, or the like as known to those skilled in electrochemistry. If another acid or a mixture of acids is used for component (A), any ratios involving component (A) should be adjusted to provide the same pH in working compositions as do the above noted preferred ratios for component (A) when it is derived entirely from nitric acid.

Component (D) is selected from the group consisting of organic azoles, preferably organic triazoles, most preferably benzotriazole. Irrespective of its exact chemical composition, component (D) is preferably present in a composition according to the invention in a concentration that is at least, with increasing preference in the order given, 0.1, 0.3, 0.5, 0.7, 0.9, 1.1, 1.3, 1.50, 1.60, 1.70, 1.80, 1.90, 1.95, 2.00, 2.05, 2.10, or 2.15 g/l and independently, primarily for economy, preferably is not more than, with increasing preference in the order given, 30, 20, 17, 14, 12, 10, 8, 6.0, 5.0, 4.5, 4.0, 3.5, 3.0, 2.7, 2.50, 2.40, 2.35, 2.30, 2.25, or 2.20 g/l. Independently of its absolute concentration and its exact chemical nature, component (D) preferably is present in a composition according to the invention in a concentration that has a ratio to the equivalent effective concentration of nitric acid[1] in the same composition, both concentrations being measured in g/l, that is at least, with increasing preference in the order given, 0.005:1.0, 0.008:1.0, 0.012:1.0, 0.018:1.0, 0.022:1.0, 0.026:1.0, 0.030:1.0, 0.034:1.0, 0.038:1.0, 0.040:1.0, or 0.042:1.0 and independently preferably, primarily for economy, is not more than, with increasing preference in the order given, 0.20:1.0,

[1]The equivalent effective concentration of nitric acid is defined as the concentration of nitric acid that would be required to be present in a composition with the same pH and oxidizing power as the actual composition, if any constituent of component (A) that is not nitric acid is replaced by a suitable amount of nitric acid and any constituent of component (C) that is not hydrogen peroxide is replaced by a suitable amount of hydrogen peroxide. 0.15:1.0, 0.12:1.0, 0.09:1.0, 0.075:1.0, 0.065:1.0, 0.057:1.0, 0.052:1.0, 0.048:1.0, 0.045:1.0, or 0.043:1.0.

Optional component (E) is preferably present in a composition according to the invention when hydrogen peroxide is present therein, as the hydrogen peroxide is likely to decompose during storage in the absence of a stabilizer. It has unexpectedly been found that the choice of component (E), which was not previously recognized to have any function in the deoxidizing composition except to stabilize hydrogen peroxide when the latter was present, can have a substantial effect on the quality of corrosion resistance obtained after a deoxidizing treatment according to the invention. Preferred constituents of component (E) are selected from the group consisting of organic molecules that contain at least two hydroxy (i.e., —OH) moieties per molecule. More preferably, at least for economy and independently for each characteristic noted, a molecule selected for component (E) also:

- is saturated (i.e., has no aromatic ring or other type of multiple bonds);
- is straight chain or, less preferably, is straight chain except for a single methyl substituent;
- has not more than, with increasing preference in the order given, 8, 6, 5, 4, or 3 carbon atoms per molecule;
- has a number of hydroxy moieties in each molecule that has a ratio to the number of carbon atoms in the same molecule that is not less than, with increasing preference in the order given, 0.20:1.0, 0.25:1.0, 0.30:1.0, 0.35:1.0, 0.40:1.0, 0.45:1.0, 0.50:1.0, 0.55:1.0, 0.60:1.0, or 0.65:1.0; and
- does not contain any polyoxyethylene blocks, or more preferably does not contain any polyoxyalkylene blocks, that include more than, with increasing preference in the order given, 22, 20, 18, 16, 14, 12, 10, 8, 5, 4, 3, or2 consecutively joined oxyalkylene moieties. The single most preferred material for component (E) is 1,2-propanediol, more commonly called propylene glycol.

In a working or concentrate composition according to the invention that contains hydrogen peroxide or another constituent that generates hydrogen peroxide in situ, the concentration of component (E) in g/l preferably has a ratio to the concentration of hydrogen peroxide, also measured in g/l, in the same composition that is at least, with increasing preference in the order given, 0.03:1.0, 0.05:1.0, 0.07:1.0, 0.09:1.0, 0.11:1.0, 0.13:1.0, 0.15:1.0, 0.17:1.0, 0.19:1.0, 0.21:1.0, 0.23:1.0, 0.25:1.0, or 0.27:1.0 and independently, primarily for economy, preferably is not more than, with increasing preference in the order given, 1.0:1.0, 0.8:1.0, 0.6:1.0, 0.55:1.0, 0.50:1.0, 0.45:1.0, 0.40:1.0, 0.38:1.0, 0.36:1.0, 0.34:1.0, 0.32:1.0, 0.30:1.0, or 0.28:1.0.

Optional component (F) as described above is not normally needed, but may be valuable in certain instances, such as if the surfaces to be deoxidized are very irregularly wetted by a composition with components (A) through (D) or (E) only.

Optional component (G) of dissolved aluminum cations is not always included in a freshly prepared working composition according to the invention, but almost always accumulates in situ during use of the composition on aluminum substrates. For this reason, it is normally preferred to include it from the beginning, in order to achieve a more consistent performance between a freshly prepared working composition and one that has been used for previous cleaning. Accordingly, the concentration of dissolved aluminum cations in a composition according to the invention preferably is at least, with increasing preference in the order given, 0.01, 0.03, 0.05, 0.07, 0.080, 0.085, 0.090, 0.095, or 0.100 g/l. At least 1.0 g/l of dissolved aluminum cations may be present without diminishing the deoxidizing effectiveness of the solution. Any concentration of aluminum cations desired in a freshly prepared composition according to the invention preferably is supplied to the composition from a readily water soluble salt of aluminum, most preferably its nitrate.

Component (D) is known to have a corrosion inhibiting effect in many environments. If present in preferred concentrations as indicated above, azole component (D) is usually satisfactory in preventing any undesired attack on aluminum substrates that are being deoxidized with it. Optional supplemental inhibitor component (H) normally is advantageously present in a working composition according to the invention only if it is important to prevent attack on some other metal that is in contact with the deoxidizing composition according to the invention but is not itself being deoxidized as an object of a process according to the invention. Such a situation most commonly arises when titanium racks are used to hold aluminum objects that are being deoxidized. Attack on titanium can be substantially reduced by including a boron-containing material, more preferably a boron-containing inorganic acid or salt thereof, other than fluoroboric acid and its salts, as at least part of optional supplemental inhibitor component (H) in a composition according to the invention. Component (H) preferably is derived from direct addition of simple boric acid, i.e., $H_3BO_3$, but can also be derived from salts of this acid or of (actual or hypothetical) condensed boric acids. In a working composition according to the invention, when minimization of dissolution of titanium from any predominantly titanium surface in contact with the working composition is desired:

the concentration as the stoichiometric equivalent as $H_3BO_3$ of all sources of boron that are not also sources of $BF_4^-$ as already defined above preferably is at least, with increasing preference in the order given, 0.4, 0.8, 1.2, 1.6, 2.0, 2.4, 2.8, 3.2, 3.30, 3.40, 3.50, 3.60, 3.70, 3.80, 3.90, or 3.97 g/l and independently preferably is, primarily for economy, not more than, with increasing preference in the order given, 20, 15, 10, 9.0, 8.0, 7.0, 6.0, 5.5, 5.0, 4.5, 4.3, or 4.1 g/l; and independently of the actual concentrations:

the ratio of the concentration of the stoichiometric equivalent as $H_3BO_3$ of all sources of boron that are not also sources of $BF_4^-$ as already defined above to the concentration of component (A) when component (A) is nitric acid preferably is at least, with increasing preference in the order given, 0.010:1.0, 0.020:1.0, 0.030:1.0, 0.040:1.0, 0.050:1.0, 0.060:1.0, 0.065:1.0, 0.069:1.0, 0.073:1.0, 0.075:1.0, or 0.077:1.0 and independently preferably is not more than, with increasing preference in the order given, 0.50:1.0, 0.40:1.0, 0.30:1.0, 0.20:1.0, 0.15:1.0, 0.13:1.0, 0.11:1.0, 0.10:1.0, 0.090:1.0, or 0.080:1.0;[2] and, independently the ratio of the concentration of the stoichiometric equivalent as $H_3BO_3$ of all sources of boron that are not also sources of $BF_4^-$ as already defined above to the concentration of the stoichiometric equivalent as $BF_4^-$ of all sources of component (B) preferably is at least, with increasing preference in the order given, 0.20:1.0, 0.40:1.0, 0.60:1.0, 1.0:1.0, 1.2:1.0, 1.4:1.0, 1.6:1.0, 1.8:1.0, 1.9:1.0, or 2.0:1.0 and independently preferably is not more than, with increasing preference in the order given, 10:1.0, 9.0:1.0, 6.0:1.0, 5.0:1.0, 4.0:1.0, 3.6:1.0, 3.2:1.0, 2.8:1.0, 2.6:1.0, 2.4:1.0, 2.20:1.0, or 2.10:1.0.

However, unless supplementary boron containing materials, i.e., those that are not sources of $BF_4^-$, are needed to prevent attack on some metal that is not being deoxidized in a process according to the invention but that nevertheless comes into contact with the deoxidizing composition used in such a process, supplementary boron containing materials are preferably omitted from a composition according to the invention, because they can have an adverse affect on the corrosion resistance achieved later on aluminum surfaces that have been deoxidized according to the invention.

[2]If another acid or a mixture of acids is used for component (A), these ratios should be adjusted to provide the same pH in working compositions as do the above noted preferred ratios for component (A) when it is derived entirely from nitric acid.

An often important characteristic of a working composition according to the invention is its etch rate on the substrate being deoxidized. The etch rate is believed to be jointly dependent on concentrations of more than one of the components in a composition according to the invention, but is usually most readily adjusted by varying the amount of the fluoroborate component (B). Several hours or even days of equilibration after additions of fluoroborate sources may be necessary to reach an etch rate value that does not change much with further storage. Additions of aluminum cations generally depress the etch rate. These and other observations make it likely that some "free fluoride" chemical species that spontaneously forms by interaction among the various components and has an unknown detailed chemical structure is actually controlling the etch rate. Irrespective of any such possibilities, however, it has been determined by experiment that the etch rate of the substrate being deoxidized by a working composition in a process according to the invention, under the conditions of deoxidation, preferably is not more than, with increasing preference in the order given, 10, 8.0, 7.0, 6.5, 6.0, 5.5, 5.0, 4.7, 4.4, 4.1, or 3.9 micrometres per hour (hereinafter usually abbreviated as "$\mu$m/hr") and independently preferably is at least, with increasing preference in the order given, 0.10, 0.30, 0.50, 0.70, 0.90, 1.00, 1.10, 1.20, 1.30, or 1.40 $\mu$m/hr. Working compositions with very high etch rates are prone to result in spotty severe corrosive failure on substrates treated with them, in addition to being wasteful of metal from the substrate. Working compositions with very low etch rates will not usually achieve adequate deoxidation within a reasonable time of contact with a substrate.

One type of concentrate composition according to the invention preferably contains components (A), (B), and, optionally, any of component (D) through (H) as defined above. At least components (A) and (B) are preferably present in such a concentrate in the same ratios to one another as are desired in the working composition(s) to be made from this type of concentrate composition. However, even if hydrogen peroxide is desired in a working composition according to the invention, it preferably is not present in the same concentrate as either of components (A) and (B) during storage of such a concentrate, as these ingredients reduce the stability of the hydrogen peroxide. Therefore, the hydrogen peroxide preferably is provided in a second concentrate, which preferably contains hydrogen peroxide and a stabilizer for it. If this is the only expected source of the stabilizer for the ultimate working composition, hydrogen peroxide and the stabilizer for it are preferably present in this second concentrate in the same ratio to each other as is desired in the final working composition(s) to be made from the concentrates. In order to minimize decomposition of hydrogen peroxide during storage of such a hydrogen peroxide and stabilizer concentrate according to the invention, the concentration of hydrogen peroxide therein preferably is not more than, with increasing preference in the order given, 50, 45, 40, 37, 34, 31, or 29%.

The other necessary and optional components may be present in either of the above-described first and second concentrates or divided between them; because of its relatively low solubility, boric acid in particular, if used, may need to be present in more than one concentrate in order to get the optimum amount of it into a working composition from economically highly concentrated concentrate compositions. Azole component (D) alternatively may also be supplied in a separate concentrate altogether in order to provide it in highly concentrated liquid form in an organic solvent for convenience in measuring. If this type of concentrate is used as a source of the azole component, the organic solvent preferably is one that acts as a stabilizer for hydrogen peroxide.

One of the advantages of a deoxidizing composition according to the invention over most prior art is that a composition according to the invention is suitable for use at relatively low temperatures. In particular, primarily for economy, in a process according to the invention the temperature of the working deoxidizing composition according to the invention preferably is not greater than, with increasing preference in the order given, 50, 45, 42, 40, or 38° C. and independently, in order to achieve deoxidation in a reasonable time, preferably is at least, with increasing preference in the order given, 15, 17, 19, 21, or 23° C.

Sufficiency of the deoxidizing effect has been found difficult to judge by any visual indication or other quick method, and the primary practical method found successful so far is to measure the resistance to salt spray of an aluminum surface that has been deoxidized according to the invention and then chromate conversion coated in a conventional manner, such as with products and processing conditions recommended in the Technical Process Bulletins for ALODINE® 600, 1200S, and 1600 aluminum conversion coating processes available from the Henkel Surface Technologies Division of Henkel Corporation (hereinafter usually abbreviated as "HST"), Madison Heights, Mich., USA. Substrates of Type 2024-T3 aluminum deoxidized according to the invention and then processed according to one of these ALODINE® processes preferably should pass a 336 hour salt spray test. The time of deoxidizing preferably is sufficient to achieve this result. As a general guideline, with the most preferred working compositions according to the invention, a passing salt spray test can generally be achieved with no more than 10 minutes of contact between the surface to be deoxidized and a deoxidizing composition according to the invention, and usually with no more than 3 minutes. For economy, of course, the time is preferably not longer than necessary to achieve the required level of deoxidizing to meet performance requirements. Furthermore, in many instances, as illustrated in the examples below, longer contact times during deoxidizing are correlated with poorer corrosion resistance of the deoxidized and subsequently chromate conversion coated surface.

Normally, before being deoxidized according to this invention, an aluminum substrate surface preferably is thoroughly cleaned in a conventional manner, such as with one of the RIDOLINE® cleaners/processes commercially available from HST.

At least the most preferred compositions and processes according to the invention meet the deoxidizing requirements of U.S. Military Specification MIL-W-6858C, ¶ 4.2.

The practice of this invention may be further appreciated by consideration of the following, non-limiting, working examples, and the benefits of the invention may be further appreciated by consideration of the comparison examples.

EXAMPLES AND COMPARISON EXAMPLES

Test panels of Type 2024-T3 aluminum sheet were subjected to the following process steps, unless otherwise noted below:

(1) Clean using at least one of the following substeps, in the order shown unless otherwise noted:

(1.1) Wipe with a cloth soaked in methyl ethyl ketone to remove superficial organic soils.

(1.2) Treat according to a RIDOLINE® 4355 cleaning process as described in Technical Process Bulletin No. 1705, Edition of Apr. 4, 1996, from HST (1.3) Treat according to a RIDOLINE® 53L cleaning process as described in Technical Process Bulletin No. 1291, Edition of May 19, 1992, from HST.

In some instances, all three of these substeps were used in the order shown. In other instances, one only of substeps (1.2) and (1.3) was omitted, and in some instances, substep (1.1) was omitted. Little if any difference in performance could be detected as a result of these cleaning variations, provided that the RIDOLINE® 4355 process was used as the last substep, so that in most instances it was used as the only substep.

(2) Rinse with tap water.

(3) Deoxidize by immersion in a composition as shown in detail below.

(4) Rinse with tap water.

(5) Conversion coat according to at least one of the ALODINE® 600 or 1600 aluminum conversion coating processes as noted above.

(6) Rinse with tap water, dry, and allow to sit for at least 72 hours.

(7) Subject to accelerated corrosion testing.

Group 1

In this group, only the hydrogen peroxide stabilizer and inhibitor components were varied. All of the deoxidizing compositions, unless otherwise stated, comprised 51 g/l of $HNO_3$, 1.9 g/l of $HBF_4$, 2.0 g/l of COBRATEC™ 99 inhibitor (a commercial product reported by its supplier to contain 99% of benzotriazole); and 31 g/l of $H_2O_2$ in addition to whatever ingredients are shown in Table 1 below, with water to make up the balance of the composition. The temperature was normal ambient human comfort temperature (i.e., 18–23° C.) unless otherwise stated. Blank cells in this table indicate that the ingredient shown at the top of the column was not added to the composition on the line where the blank appears, or that the test that would have generated a result for the cell was not performed. After deoxidizing as indicated in Table 1 and rinsing with water, the deoxidized substrates were treated with one of the conversion coatings as noted in the Table, and then subjected to salt spray testing according to American Society for Testing and Materials Method B-117. In the test result columns, results are shown in the format {pass ("P") or fail ("F") after 168 hours}/{P or F after 336 hours}. Five panels were run for each test. In order to pass, the entire set must have had no more than 15 pits, and every single panel must have had no more than five pits.

Group 2

In this group, the focus of interest was on the titanium etch rate. Each deoxidizer composition contained 5.0% of 69.4% nitric acid, 8.0% of 35% hydrogen peroxide, and 2.0 g/l of propylene glycol, and 10 g/l of sorbitol. The balance not specified was water. The titanium etch rate of a solution containing only these components was at least ten times higher than if the solution also contained either 5.0 or 10.0 g/l of boric acid. The titanium etch rate appeared slightly higher when the content was 5.0 g/l of boric acid than when it was 10 g/l, but both etch rates were so low that the difference was not practically significant.

Group 3

In this group, variables studied included the cleaning process used to prepare the substrate for deoxidizing, the amount of azole component in the compositions according to the invention, the time of exposure to the deoxidizing composition, whether the deoxidizing composition was mechanically agitated during its use, the etch rate of the deoxidizing composition, and the temperature of the deoxidizing composition during its use.

For all of Group 3, unless otherwise noted:

substep 1.2 as described for Group 1 was the only cleaning step;

all of the deoxidizing compositions comprised 51 g/l of $HNO_3$, 1.59 g/l of $BF_4^-$ (added as $HBF_4$), 8.4 g/l of propylene glycol, 31 g/l of $H_2O_2$, and 0.10 g/l of aluminum cations

TABLE 1

STABILIZING AND CORROSION INHIBITING ADDITIVES TO THE DEOXIDIZER COMPOSITIONS AND CORROSION TEST RESULTS FOR GROUP 1

| | Additives to Deoxidizing Bath, g/l | | | Salt Spray Test Results after Conversion Coating with: 600 after a Dx Time of: | | 1600 after a Dx Time of: | |
|---|---|---|---|---|---|---|---|
| No. | $H_3BO_3$ | PG | Other | 3 Min | 10 Min | 3 Min | 10 Min |
| 1.1 | | 2.0 | * | P/P | P/P | F/F | F/F |
| 1.2 | 2.0 | 2.0 | * | P/F | P/F | P/P | F/F |
| 1.3 | 2.0 | 2.0 | | P/F | F/F | P/P | P/F |
| 1.4 | 6.0 | 2.0 | | P/P | F/F | P/P | P/P |
| 1.5 | | 2.0 | NP9, 2.0 | P/P | F/F | F/F | F/F |
| 1.6 | 2.0 | 2.0 | | F/F | F/F | F/F | F/F |
| 1.7 | 10.0 | 2.0 | | P/P | F/F | F/F | F/F |

TABLE 1-continued

STABILIZING AND CORROSION INHIBITING ADDITIVES TO THE DEOXIDIZER COMPOSITIONS AND CORROSION TEST RESULTS FOR GROUP 1

| | Additives to Deoxidizing Bath, g/l | | | Salt Spray Test Results after Conversion Coating with: 600 after a Dx Time of: | | 1600 after a Dx Time of: | |
|---|---|---|---|---|---|---|---|
| No. | $H_3BO_3$ | PG | Other | 3 Min | 10 Min | 3 Min | 10 Min |
| 1.8 | 2.0 | 2.0 | Sor, 12 | P/P | P/F | P/P | P/F |
| 1.9 | | 2.0 | Sor, 5.0 | P/F | P/F | P/F | P/F |
| 1.10 | | 4.0 | | P/P | P/P | P/P | P/P |
| 1.11 | | 2.0 | GlA, 5.0 | P/P | P/F | P/P | P/F |
| 1.12 | | 4.0 | [1] | P/P | P/P | P/P | P/P |
| 1.13 | | 4.0 | [2] | P/P | P/P | P/P | P/P |
| 1.14 | | 4.0 | [3] | P/P | P/P | P/P | P/P |
| 1.15 | | 4.0 | [4] | P/P | P/P | P/P | P/P |
| 1.16 | | 4.0 | [5] | P/P | P/P | P/P | P/P |

Footnotes and Abbreviations for Table 1 (Abbreviations Also Applicable for Table 2)

*Numbers 1 and 2 did not contain COBRATEC ™ 99 inhibitor.

[1]In this instance, a 1.0 minute interval between steps 4 and 5 as shown above was interposed.

[2]In this instance, a 3.0 minute interval between steps 4 and 5 as shown above was interposed.

[3]In this instance, the rinse water temperature in step 6 as described above was 4° C.

[4]In this instance, the rinse water temperature in step 6 as described above was 21° C.

[5]In this instance, the rinse water temperature in step 6 as described above was 59° C.

"No." means "Number"; "PG" means "propylene glycol"; "Min" means "Minute(s)"; "Dx" means "Deoxidizing"; "600" and "1600" mean ALODINE ® 600 and 1600 chromate conversion coating forming chemicals respectively; "NP9" means "TERGITOL ™ NP9 surfactant", a commercial product reported by its supplier to be a condensation product between ethylene oxide and nonyl phenol having an average molecular weight of 616; "Sor" means "Sorbitol"; and "GlA" means "Gluconic acid".

(added as aluminum nitrate solution) in addition to whatever additional ingredients and/or additional or reduced amounts of the same ingredients are shown in Table 2 below, reduced amounts being indicated by a negative number in Table 2, with water to make up the balance of the composition;

contact between the deoxidizing composition and the substrate was accomplished by immersion of the latter in the former, while the temperature was maintained at normal ambient human comfort temperature (i.e., 18–23° C.).

while the deoxidizing composition was in use, it was stirred vigorously with a magnetic stirring bar.

Blank cells in Table 2 indicate that the ingredient shown at the top of the column was not added to the composition on the line where the blank appears, or that the test that would have generated a result for the cell was not performed. After deoxidizing as indicated in the Table and rinsing with water, the deoxidized substrates were treated with one of the conversion coatings as noted in the Table, and then subjected to accelerated corrosion testing. Five panels were run for each test. In order to pass, the entire set must have had no more than 15 pits, and every single panel must have had no more than five pits.

TABLE 2

ADDITIVES TO THE DEOXIDIZER COMPOSITIONS, VARIATIONS OF CORROSION TEST CONDITIONS, AND CORROSION TEST RESULTS FOR GROUP 3

| | Additives to Deoxidizing Bath, g/l | | | | Dx Times, | Post-Treat- | Test Result for: | |
|---|---|---|---|---|---|---|---|---|
| No. | $H_3BO_3$ | PG | BTZ | Other | Minutes | ment | MIL-C-5541 | MIL-C-81706 |
| 3.1 | | −3.0 | 0.50 | | 3.0 | 1600 | P | F |
| 3.2 | | −3.0 | 0.50 | | 3.0 | 1600 | P | F |
| 3.3 | | −3.0 | 0.50 | | 10.0 | 1600 | P | F |
| 3.4 | | −3.0 | 0.50 | | 10.0 | 1600 | P | F |
| 3.5* | | −3.0 | 0.50 | | 3.0 | 1600 | N | N |
| 3.6* | | −3.0 | 0.50 | | 10.0 | 1600 | N | N |
| 3.7 | | −2.0 | 1.0 | | 3.0 | 1600 | N | P |
| 3.8 | | −2.0 | 1.0 | | 3.0 | 1600 | N | P |
| 3.9 | | −2.0 | 1.0 | | 10.0 | 1600 | P | P |
| 3.10 | | −2.0 | 1.0 | | 10.0 | 1600 | F | F |
| 3.11* | | −2.0 | 1.0 | | 3.0 | 1600 | N | N |
| 3.12* | | −2.0 | 1.0 | | 10.0 | 1600 | N | N |
| 3.13 | | −1.0 | 1.5 | | 3.0 | 1600 | N | N |
| 3.14 | | −1.0 | 1.5 | | 3.0 | 1600 | N | P |
| 3.15 | | −1.0 | 1.5 | | 10.0 | 1600 | F | F |
| 3.16 | | −1.0 | 1.5 | | 10.0 | 1600 | P | F |
| 3.17* | | −1.0 | 1.5 | | 3.0 | 1600 | N | N |
| 3.18* | | −1.0 | 1.5 | | 10.0 | 1600 | N | N |
| 3.19 | | | 2.0 | | 3.0 | 1600 | N | N |
| 3.20 | | | 2.0 | | 3.0 | 1600 | N | N |
| 3.21 | | | 2.0 | | 10.0 | 1600 | P | F |
| 3.22 | | | 2.0 | | 10.0 | 1600 | N | P |
| 3.23* | | | 2.0 | | 3.0 | 1600 | N | N |
| 3.24* | | | 2.0 | | 10.0 | 1600 | N | N |
| 3.25 | | | 2.0 | | 1.0 | 1600 | N | P |
| 3.26 | | | 2.0 | | 1.0 | 1600 | N | N |
| 3.27* | | | 2.0 | | 1.0 | 1600 | N | N |
| 3.28* | | | 2.0 | | 1.0 | 1600 | N | N |
| 3.29 | | | 2.15 | | 3.0 | 1600 | N | N |
| 3.30 | | | 2.15 | | 3.0 | 1600 | N | N |
| 3.31 | | | 2.15 | | 10.0 | 1600 | P | P |
| 3.32 | | | 2.15 | | 10.0 | 1600 | P | P |
| 3.33* | | | 2.15 | | 3.0 | 1600 | N | N |
| 3.34* | | | 2.15 | | 10.0 | 1600 | F | F |
| 3.35 | | 2.0 | 3.2 | | 3.0 | 1600 | N | N |
| 3.36 | | 2.0 | 3.2 | | 3.0 | 1600 | N | N |
| 3.37 | | 2.0 | 3.2 | | 10.0 | 1600 | P | P |
| 3.38 | | 2.0 | 3.2 | | 10.0 | 1600 | P | F |
| 3.39* | | 2.0 | 3.2 | | 3.0 | 1600 | N | N |
| 3.40* | | 2.0 | 3.2 | | 10.0 | 1600 | N | N |
| 3.41 | | 4.0 | 4.3 | | 3.0 | 1600 | F | F |
| 3.42 | | 4.0 | 4.3 | | 3.0 | 1600 | N | N |
| 3.43 | | 4.0 | 4.3 | | 10.0 | 1600 | N | P |
| 3.44 | | 4.0 | 4.3 | | 10.0 | 1600 | F | F |
| 3.45* | | 4.0 | 4.3 | | 3.0 | 1600 | N | N |
| 3.46* | | 4.0 | 4.3 | | 10.0 | 1600 | N | N |
| 3.47 | 5.0 | | 2.15 | Sor, 5.0 | 3.0 | 1600 | N | N |
| 3.48 | 5.0 | | 2.15 | Sor, 5.0 | 3.0 | 1600 | N | p |
| 3.49 | 5.0 | | 2.15 | Sor, 5.0 | 3.0 | 1600 | N | N |
| 3.50 | 5.0 | | 2.15 | Sor, 5.0 | 3.0 | 1600 | N | N |
| 3.51* | | −0.3 | 2.0 | | 10.0 | 600 | F | F |
| 3.52* | | −0.3 | 2.0 | | 3.0 | 600 | N | N |
| 3.53* | | −0.3 | 2.0 | | 10.0 | 1600 | P | P |
| 3.54* | | −0.3 | 2.0 | | 3.0 | 1600 | N | N |
| 3.55 | | −0.3 | 2.0 | | 3.0 | 600 | N | P |
| 3.56 | | −0.3 | 2.0 | | 10.0 | 600 | F | F |
| 3.57 | | −0.3 | 2.0 | | 3.0 | 1600 | P | P |
| 3.58 | | −0.3 | 2.0 | | 10.0 | 1600 | F | F |
| 3.59 | | −0.3 | 2.0 | | 1.0 | 600 | N | N |
| 3.60 | | −0.3 | 2.0 | | 1.0 | 600 | N | N |
| 3.61 | | −0.3 | 2.0 | | 1.0 | 1600 | N | N |
| 3.62 | | −0.3 | 2.0 | | 1.0 | 1600 | N | N |
| 3.63* | | −0.3 | 2.0 | | 1.0 | 600 | N | N |
| 3.64* | | −0.3 | 2.0 | | 1.0 | 1600 | N | N |
| 3.65 | | −0.3 | 2.0 | | 3.0 | 600 | P | P |
| 3.66 | | −0.3 | 2.0 | | 3.0 | 600 | N | N |
| 3.67 | | −0.3 | 2.0 | | 3.0 | 1600 | N | N |
| 3.68 | | −0.3 | 2.0 | | 3.0 | 1600 | N | N |
| 3.69* | | −0.3 | 2.0 | | 3.0 | 600 | N | N |
| 3.70* | | −0.3 | 2.0 | | 3.0 | 1600 | N | N |
| 3.71 | | −0.3 | 2.0 | | 3.0 | 600 | N | N |

TABLE 2-continued

ADDITIVES TO THE DEOXIDIZER COMPOSITIONS, VARIATIONS OF CORROSION TEST CONDITIONS, AND CORROSION TEST RESULTS FOR GROUP 3

| | Additives to Deoxidizing Bath, g/l | | | | Dx Times, | Post-Treat- | Test Result for: | |
|---|---|---|---|---|---|---|---|---|
| No. | $H_3BO_3$ | PG | BTZ | Other | Minutes | ment | MIL-C-5541 | MIL-C-81706 |
| 3.72 | | −0.3 | 2.0 | | 3.0 | 1600 | N | N |
| 3.73 | | −4.0 | 2.0 | | 3.0 | 600 | N | P |
| 3.74 | | −4.0 | 2.0 | | 3.0 | 600 | N | N |
| 3.75 | | −4.0 | 2.0 | | 3.0 | 1600 | P | N |
| 3.76 | | −4.0 | 2.0 | | 3.0 | 1600 | N | P |
| 3.77 | | −4.0 | 2.0 | | 3.0 | 600 | N | N |
| 3.78 | | −4.0 | 2.0 | | 10.0 | 600 | P | P |
| 3.79 | | −4.0 | 2.0 | | 3.0 | 1600 | N | N |
| 3.80 | | −4.0 | 2.0 | | 10.0 | 1600 | N | P |
| 3.81 | | −4.0 | 2.0 | | 3.0 | 600 | | N |
| 3.82 | | −4.0 | 2.0 | | 3.0 | 600 | | N |
| 3.83 | | | 2.0 | Tmp. 16° C. | 3.0 | 1600 | F | F |
| 3.84 | | | 2.0 | Tmp. 16° C. | 3.0 | 1600 | N | F |
| 3.85 | | | 2.0 | Tmp. 16° C. | 10.0 | 1600 | N | P |
| 3.86 | | | 2.0 | Tmp. 16° C. | 10.0 | 1600 | N | P |
| 3.87 | | | 2.0 | Tmp. 27° C. | 3.0 | 1600 | N | P |
| 3.88 | | | 2.0 | Tmp. 27° C. | 3.0 | 1600 | N | P |
| 3.89 | | | 2.0 | Tmp. 27° C. | 10.0 | 1600 | N | P |
| 3.90 | | | 2.0 | Tmp. 27° C. | 10.0 | 1600 | N | F |
| 3.91 | | | 2.0 | Tmp. 32° C. | 3.0 | 1600 | N | P |
| 3.92 | | | 2.0 | Tmp. 32° C. | 3.0 | 1600 | N | P |
| 3.93 | | | 2.0 | Tmp. 32° C. | 10.0 | 1600 | N | P |
| 3.94 | | | 2.0 | Tmp. 32° C. | 10.0 | 1600 | N | F |
| 3.95 | | | 2.0 | E.R. 2.5 | 3.0 | 1600 | N | N |
| 3.96 | | | 2.0 | E.R. 2.5 | 3.0 | 1600 | N | N |
| 3.97 | | | 2.0 | E.R. 2.5 | 10.0 | 1600 | N | P |
| 3.98 | | | 2.0 | E.R. 2.5 | 10.0 | 1600 | N | P |
| 3.99 | | | 2.0 | E.R. 1.4 | 3.0 | 1600 | N | N |
| 3.100 | | | 2.0 | E.R. 1.4 | 3.0 | 1600 | N | N |
| 3.101 | | | 2.0 | E.R. 1.4 | 10.0 | 1600 | N | N |
| 3.102 | | | 2.0 | E.R. 1.4 | 10.0 | 1600 | N | P |
| 3.103 | | | 2.0 | E.R. 3.0 | 3.0 | 1600 | F | F |
| 3.104 | | | 2.0 | E.R. 3.0 | 3.0 | 1600 | P | P |
| 3.105 | | | 2.0 | E.R. 3.0 | 10.0 | 1600 | F | F |
| 3.106 | | | 2.0 | E.R. 3.0 | 10.0 | 1600 | F | F |
| 3.107 | | | 2.0 | E.R. 3.6 | 3.0 | 1600 | N | N |
| 3.108 | | | 2.0 | E.R. 3.6 | 3.0 | 1600 | N | N |
| 3.109 | | | 2.0 | E.R. 3.6 | 10.0 | 1600 | P | P |
| 3.110 | | | 2.0 | E.R. 3.6 | 10.0 | 1600 | N | P |
| 3.111 | | | 2.0 | E.R. 4.1 | 3.0 | 1600 | N | N |
| 3.112 | | | 2.0 | E.R. 4.1 | 3.0 | 1600 | N | N |
| 3.113 | | | 2.0 | E.R. 4.1 | 10.0 | 1600 | N | P |
| 3.114 | | | 2.0 | E.R. 4.1 | 10.0 | 1600 | P | F |
| 3.115 | | | 2.0 | E.R. 4.6 | 3.0 | 1600 | P | P |
| 3.116 | | | 2.0 | E.R. 4.6 | 3.0 | 1600 | N | P |
| 3.117 | | | 2.0 | E.R. 4.6 | 10.0 | 1600 | N | F |
| 3.118 | | | 2.0 | E.R. 4.6 | 10.0 | 1600 | N | F |
| 3.119 | | | 2.0 | E.R. 5.1 | 3.0 | 1600 | N | P |
| 3.120 | | | 2.0 | E.R. 5.1 | 3.0 | 1600 | P | P |
| 3.121 | | | 2.0 | E.R. 5.1 | 10.0 | 1600 | F | F |
| 3.122 | | | 2.0 | E.R. 5.1 | 10.0 | 1600 | F | F |
| 3.123 | | | 2.0 | E.R. 2.9 | 3.0 | 1600 | N | P |
| 3.124 | | | 2.0 | E.R. 2.9 | 3.0 | 1600 | N | P |
| 3.125 | | | 2.0 | E.R. 2.9 | 10.0 | 1600 | P | F |
| 3.126 | | | 2.0 | E.R. 2.9 | 10.0 | 1600 | N | F |
| 3.127 | | | 2.0 | E.R. 3.0 | 3.0 | 1600 | P | F |
| 3.128 | | | 2.0 | E.R. 3.0 | 3.0 | 1600 | N | P |
| 3.129 | | | 2.0 | E.R. 3.0 | 10.0 | 1600 | N | P |
| 3.130 | | | 2.0 | E.R. 3.0 | 10.0 | 1600 | N | P |
| 3.131 | | | 2.0 | E.R. 3.3; Tmp. 27° C. | 3.0 | 1600 | P | P |
| 3.132 | | | 2.0 | E.R. 3.3; Tmp. 27° C. | 3.0 | 1600 | N | N |
| 3.133 | | | 2.0 | E.R. 3.3; Tmp. 27° C. | 10.0 | 1600 | P | F |
| 3.134 | | | 2.0 | E.R. 3.3; Tmp. 27° C. | 10.0 | 1600 | N | F |
| 3.135 | | | 2.0 | E.R. 3.8; Tmp. 27° C. | 3.0 | 1600 | F | F |
| 3.136 | | | 2.0 | E.R 3.8; Tmp. 27° C. | 3.0 | 1600 | N | N |

TABLE 2-continued

ADDITIVES TO THE DEOXIDIZER COMPOSITIONS, VARIATIONS OF CORROSION TEST CONDITIONS, AND CORROSION TEST RESULTS FOR GROUP 3

| | Additives to Deoxidizing Bath, g/l | | | | Dx Times, | Post-Treat- | Test Result for: | |
|---|---|---|---|---|---|---|---|---|
| No. | $H_3BO_3$ | PG | BTZ | Other | Minutes | ment | MIL-C-5541 | MIL-C-81706 |
| 3.137 | | | 2.0 | E.R. 3.8; Tmp. 27° C. | 10.0 | 1600 | N | P |
| 3.138 | | | 2.0 | E.R. 3.8; Tmp. 27° C. | 10.0 | 1600 | N | P |
| 3.139 | | | 2.0 | E.R 4.4; Tmp. 27° C. | 3.0 | 1600 | P | P |
| 3.140 | | | 2.0 | E.R. 4.4; Tmp. 27° C. | 3.0 | 1600 | N | N |
| 3.141 | | | 2.0 | E.R. 4.4; Tmp. 27° C. | 10.0 | 1600 | N | P |
| 3.142 | | | 2.0 | E.R 4.4; Tmp. 27° C. | 10.0 | 1600 | P | F |
| 3.143 | | | 2.0 | E.R. 5.1; Tmp. 27° C. | 3.0 | 1600 | N | F |
| 3.144 | | | 2.0 | E.R. 5.1; Tmp. 27° C. | 3.0 | 1600 | N | P |
| 3.145 | | | 2.0 | E.R. 5.1; Tmp. 27° C. | 10.0 | 1600 | P | N |
| 3.146 | | | 2.0 | E.R. 5.1; Tmp. 27° C. | 10.0 | 1600 | F | F |
| 3.147 | | | 2.0 | E.R. 6.2; Tmp. 32° C. | 3.0 | 1600 | N | P |
| 3.148 | | | 2.0 | E.R. 6.2; Tmp. 32° C. | 3.0 | 1600 | N | N |
| 3.149 | | | 2.0 | E.R. 6.2; Tmp. 32° C. | 10.0 | 1600 | N | F |
| 3.150 | | | 2.0 | E.R. 6.2; Tmp. 32° C. | 10.0 | 1600 | F | F |
| 3.151 | | | 2.0 | E.R. 5.1; Tmp. 32° C. | 3.0 | 1600 | N | N |
| 3.152 | | | 2.0 | E.R. 5.1; Tmp. 32° C. | 3.0 | 1600 | P | P |
| 3.153 | | | 2.0 | E.R. 5.1; Tmp. 32° C. | 10.0 | 1600 | N | P |
| 3.154 | | | 2.0 | E.R. 5.1; Tmp. 32° C. | 10.0 | 1600 | N | P |
| 3.155 | | | 2.0 | E.R. 3.8; Tmp. 32° C. | 3.0 | 1600 | N | N |
| 3.156 | | | 2.0 | E.R. 3.8; Tmp. 32° C. | 3.0 | 1600 | N | N |
| 3.157 | | | 2.0 | E.R. 3.8; Tmp. 32° C. | 10.0 | 1600 | P | F |
| 3.158 | | | 2.0 | E.R. 3.8; Tmp. 32° C. | 10.0 | 1600 | N | F |
| 3.159 | | | 2.0 | E.R. 4.4; Tmp. 32° C. | 3.0 | 1600 | F | F |
| 3.160 | | | 2.0 | E.R. 4.4; Tmp. 32° C. | 3.0 | 1600 | N | N |
| 3.161 | | | 2.0 | E.R. 4.4; Tmp. 32° C. | 10.0 | 1600 | N | P |
| 3.162 | | | 2.0 | E.R. 4.4; Tmp. 32° C. | 10.0 | 1600 | N | P |
| 3.163 | | | 2.0 | E.R. 2.8; Tmp. 24° C. | 3.0 | 1600 | N | N |
| 3.164 | | | 2.0 | E.R. 2.8; Tmp. 24° C. | 3.0 | 1600 | N | N |
| 3.165 | | | 2.0 | E.R. 2.8; Tmp. 24° C. | 10.0 | 1600 | N | N |
| 3.166 | | | 2.0 | E.R. 2.8; Tmp. 24° C. | 10.0 | 1600 | N | N |
| 3.167† | 5.0 | −4.4 | 2.0 | See Note 1 | 3.0 | 600 | N | N |
| 3.168† | 5.0 | −4.4 | 2.0 | See Note 1 | 3.0 | 600 | N | N |
| 3.169† | 5.0 | −4.4 | 2.0 | See Note 1 | 10.0 | 600 | F | F |
| 3.170† | 5.0 | −4.4 | 2.0 | See Note 1 | 10.0 | 600 | F | F |
| 3.171† | 5.0 | −4.4 | 2.0 | See Note 1 | 3.0 | 1600 | N | N |
| 3.172† | 5.0 | −4.4 | 2.0 | See Note 1 | 3.0 | 1600 | N | N |
| 3.173† | 5.0 | −4.4 | 2.0 | See Note 1 | 10.0 | 1600 | F | F |
| 3.174† | 5.0 | −4.4 | 2.0 | See Note 1 | 10.0 | 1600 | F | F |
| 3.175*† | 5.0 | −4.4 | 2.0 | See Note 1 | 3.0 | 600 | N | P |

TABLE 2-continued

ADDITIVES TO THE DEOXIDIZER COMPOSITIONS, VARIATIONS OF CORROSION TEST CONDITIONS, AND CORROSION TEST RESULTS FOR GROUP 3

| | Additives to Deoxidizing Bath, g/l | | | | Dx Times, | Post-Treat- | Test Result for: | |
|---|---|---|---|---|---|---|---|---|
| No. | $H_3BO_3$ | PG | BTZ | Other | Minutes | ment | MIL-C-5541 | MIL-C-81706 |
| 3.176* † | 5.0 | −4.4 | 2.0 | See Note 1 | 10.0 | 600 | F | F |
| 3.177* † | 5.0 | −4.4 | 2.0 | See Note 1 | 3.0 | 1600 | N | P |
| 3.178* † | 5.0 | −4.4 | 2.0 | See Note 1 | 10.0 | 1600 | F | F |
| 3.179 | 5.0 | −4.4 | 2.0 | See Note 1 | 3.0 | 600 | N | N |
| 3.180 | 5.0 | −4.4 | 2.0 | See Note 1 | 10.0 | 600 | N | N |
| 3.181 | 5.0 | −4.4 | 2.0 | See Note 1 | 3.0 | 1600 | N | N |
| 3.182 | 5.0 | −4.4 | 2.0 | See Note 1 | 10.0 | 1600 | N | P |
| 3.183 | | −6.4 | 2.0 | See Note 1 | 3.0 | 1600 | P | P |
| 3.184 | | −6.4 | 2.0 | See Note 1 | 3.0 | 1600 | N | P |
| 3.185 | | −6.4 | 2.0 | See Note 1 | 10.0 | 1600 | F | F |
| 3.186 | | −6.4 | 2.0 | See Note 1 | 10.0 | 1600 | F | F |
| 3.187* | | −6.4 | 2.0 | See Note 1 | 3.0 | 1600 | N | P |
| 3.188* | | −6.4 | 2.0 | See Note 1 | 10.0 | 1600 | P | F |
| 3.189‡ | | −6.4 | 2.0 | See Note 1 | 3.0 | 1600 | F | F |
| 3.190‡ | | −6.4 | 2.0 | See Note 1 | 10.0 | 1600 | P | P |
| 3.191 | | −6.4 | 2.0 | See Note 1 | 3.0 | 1600 | N | P |
| 3.192 | | −6.4 | 2.0 | See Note 1 | 10.0 | 1600 | P | F |

Footnotes, Other Notes, and Additional Abbreviations for Table 2

*No stirring of the composition was maintained during the deoxidizing step for these examples or comparison examples.

†In these instances, the substrates were cleaned according to a RIDOLINE ® 53L Cleaner Process as commercially available from Henkel Surface Technologies Div. of Henkel Corp. instead of a RIDOLINE ® 4355 process before being deoxidized.

‡In these instances, the substrates were cleaned first according to a RIDOLINE ® 4355 Cleaner Process as commercially available from Henkel Surface Technologies Div. of Henkel Corp. and then additionally cleaned with a RIDOLINE ® 53L process before being deoxidized.

Note 1: The concentrations of nitric acid, fluoroboric acid and hydrogen peroxide in the working composition used for these examples was that resulting from the following procedure: A precursor concentrate consisting of 1.2 parts of 70% $HNO_3$ in water, 0.048 parts of 48% solution of $HBF_4$ in water, and 2.75 parts of additional deionized water was first prepared. The working composition contained 1 liter of this precursor concentrate and 0.40 liter of a 35% solution of $H_2O_2$ in 5.0 liters of total volume.

"BTZ" means "Benzotriazole"; "Tmp." means "Temperature of the working deoxidizing composition during its contact with the substrate was"; "E.R." followed by a number "x" means "the etch rate of the substrate by the working deoxidizing composition under the conditions used for deoxidizing was x $\mu$m/hr, and the standard concentration of $BF_4^-$ was increased or decreased if necessary to achieve this etch rate".

In the test result columns of Table 2, results are shown as no pits ("N") on any of the panels, pass ("P") with at least one pit on at least one of the five panels, or fail ("F") after the 168 hours of testing prescribed for MIL-C-5541 and the 336 hours prescribed for MIL-C-81706. In many instances, replicate sets were tested, and each is shown separately because sometimes widely varying results were achieved, particularly under less preferred conditions.

The invention claimed is:

1. An aqueous liquid composition that is suitable either as a concentrate, after dilution with water, or both as a concentrate and after dilution with water, for Deoxidizing etching of aluminum surfaces by contact therewith, said composition comprising water and:

(A) a component of dissolved acid wherein component (A) consists of a concentration of nitric acid that is from about 44 to about 70 g/l;

(B) a component of dissolved fluoroborate anions present in a concentration that is from about 1.50 to about 3.0 g/l and is derived from fluoroboric acid, its salts, or both;

the ratio of the concentration of dissolved fluoroborate anions to dissolved nitric acid in the composition is from 0.029:1.0 to 0.055:1.0;

(C) a component of dissolved oxidizing agent that is not part of either of components (A) or (B) as recited next above; wherein component (C) consists of from about 25 to about 40 g/l of hydrogen peroxide;

the concentration of hydrogen peroxide has a ratio to the concentration of fluoroborate anions that is from about 12.0:1.0 to about 20:1.0;

the concentration of hydrogen peroxide has a ratio to the concentration of nitric acid that is from about 0.50:1.0 to about 0.90:1.0;

the composition also comprises propylene glycol in a ratio to hydrogen peroxide, in the same concentration units, that is from about 0.13:1.0 to about 0.30:1.0; and (D) a component of dissolved organic molecules that is not part of any of components (A)–(C) as recited next above, comprising from about 0.46 to about 0.88 g/l of benzotriazole.

2. An aqueous liquid composition that is suitable either as a concentrate, after dilution with water, or both as a concentrate and after dilution with water, for deoxidizing etching of aluminum surfaces by contact therewith, said composition made by mixing with a first mass of water at least the following additional masses;

(A) a second mass of a component of dissolved acid wherein said second mass consists of from about 44 to about 70 g/l of nitric acid:

(B) a third mass of a water soluble source of fluoroborate anions providing a Sixth mass of fluoroborate anions that corresponds to a concentration that is from about 1.50 to about 3.0 g/l in the total composition and is derived from fluoroboric acid, its salts, or both:

the ratio of said sixth mass of fluoroborate anions to said second mass is from 0.029:1.0 to 0.055:1 0, (C) a fourth mass of a component of dissolved oxidizing agent that is not part of either of masses (A) or (B) as recited next above wherein said fourth mass consists of hydrogen peroxide and corresponds to from about 25 to about 40 g/l of hydrogen peroxide in the total composition said fourth mass has a ratio to said sixth mass of fluoroborate anions that is from about 12.0:1.0 to about 20:1.0;

said fourth mass of hydrogen peroxide has a ratio to said second mass of nitric acid that is from about 0.50:1.0 to about 0.90:1.0;

there is also mixed with said first mass of water a seventh mass of propylene glycol that has a ratio to said fourth mass that is from about 0.13:1.0 to about 0.30:1.0; and (D) a fifth mass of organic azole molecules wherein said fifth mass is benzotriazole and constitutes from about 0.46 to about 0.88 g/l of the total composition.

* * * * *

UNITED STATES PATENT AND TRADEMARK OFFICE

CERTIFICATE OF CORRECTION

PATENT NO. : 6,649,081 B1
DATED : November 18, 2003
INVENTOR(S) : Johnson et al.

It is certified that error appears in the above-identified patent and that said Letters Patent is hereby corrected as shown below:

Column 19,
Line 55, delete “Deoxidizing” and insert -- deoxidizing --.

Column 20,
Line 67, delete “;” and insert -- : --.

Column 21,
Lines 3 and 8, delete “:” and insert -- ; --.
Line 5, delete “Sixth” and insert -- sixth --.
Line 10, delete “0.055:1 0,” and insert -- 0.055:1.0; --.
Lines 15 through 16, insert -- ; -- after “composition”.

Signed and Sealed this

Seventh Day of March, 2006

JON W. DUDAS
*Director of the United States Patent and Trademark Office*